United States Patent [19]

Mengel et al.

[11] Patent Number: 4,515,226

[45] Date of Patent: May 7, 1985

[54] TOOTH DESIGN TO AVOID SHEARING STRESSES

[75] Inventors: Hans-Eckhard Mengel; Hermann Munzel, both of Celle, Fed. Rep. of Germany

[73] Assignee: Norton Christensen, Inc., Salt Lake City, Utah

[21] Appl. No.: 473,021

[22] Filed: Mar. 7, 1983

[51] Int. Cl.[3] ..... E21B 10/46

[52] U.S. Cl. ..... 175/57; 175/410; 175/329

[58] Field of Search ..... 175/329, 330, 410, 374

[56] References Cited

U.S. PATENT DOCUMENTS

| | | | |
|---|---|---|---|
| 2,818,233 | 12/1957 | Williams, Jr. | 175/330 |
| 3,027,952 | 4/1962 | Brooks | 175/329 |
| 3,318,399 | 5/1967 | Garner | 175/329 |
| 3,442,342 | 5/1969 | McElya | 175/374 |
| 3,747,699 | 7/1973 | Feenstra | 175/329 |
| 3,800,892 | 4/1974 | Fischer | 175/410 |
| 4,373,593 | 2/1983 | Phaal | 175/329 |

FOREIGN PATENT DOCUMENTS

| | | | |
|---|---|---|---|
| 0032791 | 7/1981 | European Pat. Off. | 175/329 |

OTHER PUBLICATIONS

Geoset Catalog, General Electric, 10-18-1982.

Coal Age, Nov. 1958, New Carboloy Negative Rake Bit Substantially Reduces Tip Breakage.

*Primary Examiner*—Stephen J. Novosad

*Assistant Examiner*—Michael Starinsky

*Attorney, Agent, or Firm*—Beehler, Pavitt, Siegemund, Jagger & Martella

[57] ABSTRACT

Teeth disposed on the bit face of a rotating bit are, angularly oriented on the sloping surface of the bit face such that a vertical loading force which is applied to each tooth vectorially sums with a wedging force exerted by the rock formation on each tooth to create a resultant force applied to the diamond cutting element included within the tooth. The angular orientation of the tooth is chosen such that the resultant force is applied to the diamond cutting element in a direction which minimizes shear stress on the element. For example, in the case where the diamond cutting element is an equilateral triangular prismatic element tangentially set on the bit face with one apical edge defined by two adjacent triangular sides outermost on the tooth, the orientation or inclination of the tooth with respect to the vertical loading force and wedge force is such that the resulting force lies near or on the bisector of the dihedral angle formed by the apical edge. Similarly, the diamond cutting element is rearwardly raked in the longitudinal direction, generally parallel to the tangential motion during normal drilling as defined by the rotation of the bit, such that the vectorial sum of the vertical loading force in a reactive cutting force applies a resultant force on the diamond cutting element in a direction which minimizes shear stress, namely, in the example in a direction approximately perpendicular to one of the end faces of the triangular prismatic diamond cutting element.

12 Claims, 8 Drawing Figures

FIG. 1
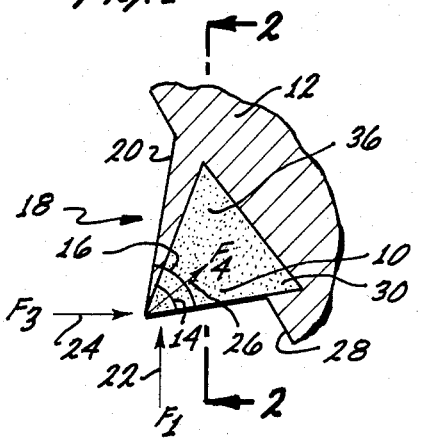
FIG. 2
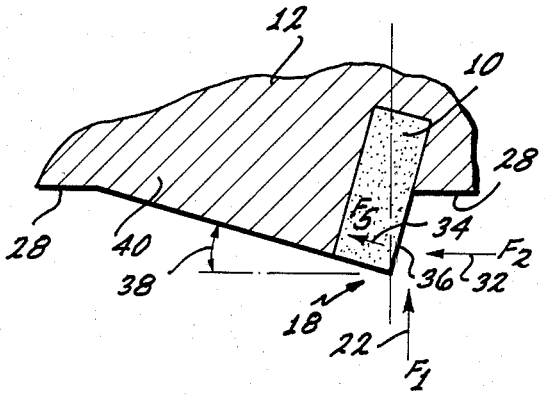
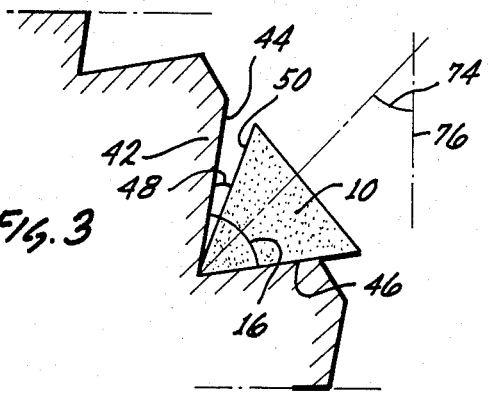
FIG. 3
FIG. 5
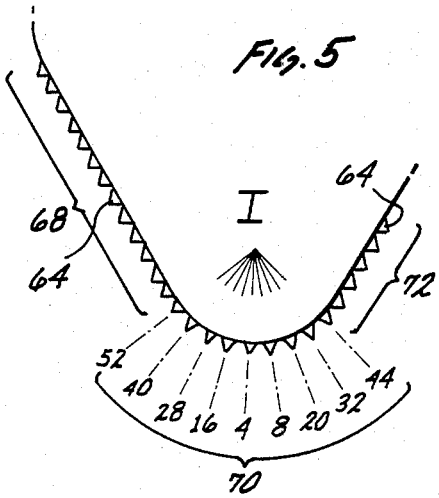
FIG. 6
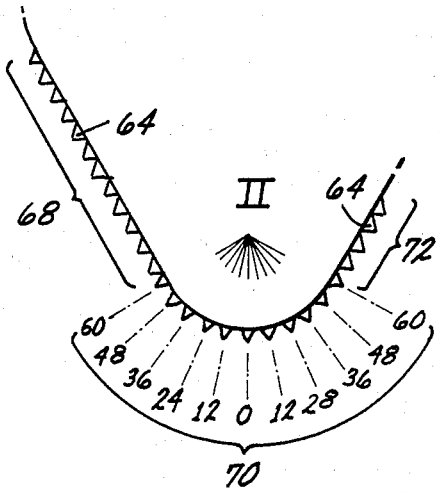
FIG. 7
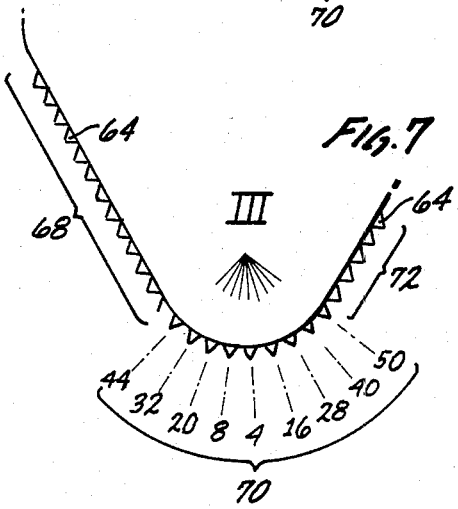

TOOTH DESIGN TO AVOID SHEARING STRESSES

BACKGROUND OF THE INVENTION

1. Field of the Invention

The present invention relates to the field of earth boring tools and in particular to rotating bits incorporating diamond cutting elements.

2. Description of the Prior Art

The use of diamonds in drilling products is well known. More recently synthetic diamonds both single crystal diamonds (SCD) and polycrystalline diamonds (PCD) have become commercially available from various sources and have been used in such products, with recognized advantages. For example, natural diamond bit effect drilling with a plowing action in comparison to crushing in the case of a roller cone bit, whereas synthetic diamonds tend to cut by a shearing action. In the case of rock formations, for example, it is believed that less energy is required to fail the rock in shear than in compression.

More recently, a variety of synthetic diamond products has become available commercially some of which are available as polycrystalline products. Crystalline diamonds preferentially fractures on (111), (110) and (100) planes whereas PCD tends to be isotropic and exhibits this same cleavage but on a microscale and therefore resists catastrophic large scale cleavage failure. The result is a retained sharpness which appears to resist polishing and aids in cutting. Such products are described, for example, in U.S. Pat. Nos. 3,193,280; 3,745,623; 3,816,085; 4,104,344 and 4,224,380.

In general, the PCD products are fabricated from synthetic and/or appropriately sized natural diamond crystals under heat and pressure and in the presence of a solvent/catalyst to form the polycrystalline structure. In one form of product, the polycrystalline structures includes sintering aid material distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being achieved by dissolving out the nondiamond material or at least a portion thereof, as disclosed for example, in U.S. Pat. Nos. 3,745,623; 4,104,344 and 4,224,380. for convenience, such a material may be described as a porous PCD, as referenced in U.S. Pat. No. 4,224,380.

Polycrystalline diamonds have been used in drilling products either as individual compact elements or as relatively thin PCD tables supported on a cemented tungsten carbide (WC) support backings. In one form, the PCD compact is supported on a cylindrical slug about 13.3 mm in diameter and about 3 mm long, with a PCD table of about 0.5 to 0.6 mm in cross section on the face of the cutter. In another version, a stud cutter, the PCD table also is supported by a cylindrical substrate of tungsten carbide of about 3 mm by 13.3 mm in diameter by 26 mm in overall length. These cylindrical PCD table faced cutters have been used in drilling products intended to be used in soft to medium-hard formations.

Individual PCD elements of various geometrical shapes have been used as substitutes for natural diamonds in certain applications on drilling products. However, certain problems arose with PCD elements used as individual pieces of a given carat size or weight. In general, natural diamond, available in a wide variety of shapes and grades, was placed in predefined locations in a mold, and production of the tool was completed by various conventional techniques. The result is the formation of a metal carbide matrix which holds the diamond in place, this matrix sometimes being referred to as a crown, the latter attached to a steel blank by a metallurgical and mechanical bond formed during the process of forming the metal matrix. Natural diamond is sufficiently thermally stable to withstand the heating process in metal matrix formation.

In this procedure above described, the natural diamond could be either surface-set in a predetermined orientation, or impregnated, i.e., diamond is distributed throughout the matrix in grit or fine particle form.

With early PCD elements, problems arose in the production of drilling products because PCD elements especially PCD tables on carbide backing tended to be thermally unstable at the temperature used in the furnacing of the metal matrix bit crown, resulting in catastrophic failure of the PCD elements if the same procedures as were used with natural diamonds were used with them. It was believed that the catastrophic failure was due to thermal stress cracks from the expansion of residual metal or metal alloy used as the sintering aid in the formation of the PCD element.

Brazing techniques were used to fix the cylindrical PCD table faced cutter into the matrix using temperature unstable PCD products. Brazing materials and procedures were used to assure that temperatures were not reached which would cause catastrophic failure of the PCD element during the manufacture of the drilling tool. The result was that sometimes the PCD components separated from the metal matrix, thus adversely affecting performance of the drilling tool.

With the advent of thermally stable PCD elements, typically porous PCD material, it was believed that such elements could be surface-set into the metal matrix much in the same fashion as natural diamonds, thus simplifying the manufacturing process of the drill tool, and providing better performance due to the fact that PCD elements were believed to have advantages of less tendency to polish, and lack of inherently weak cleavage planes as compared to natural diamond.

Significantly, the current literature relating to porous PCD compacts suggests that the element be surface-set. The porous PCD compacts, and those said to be temperature stable up to about 1200° C. are available in a variety of shapes, e.g., cylindrical and triangular. The triangular material typically is about 0.3 carats in weight, measures 4 mm on a side and is about 2.6 mm thick. It is suggested by the prior art that the triangular porous PCD compact by surface-set on the face with a minimal point exposure, i.e., less than 0.5 mm above the adjacent metal matrix face for rock drills. Larger one per carat synthetic triangular diamonds have also become available, measuring 6 mm on a side and 3.7 mm thick, but no recommendation has been made as to the degee of exposure for such a diamond. In the case of abrasive rock, it is suggested by the prior art that the triangular element be set completely below the metal matrix. For soft nonabrasive rock, it is suggested by the prior art that the triangular element be set in a radial orientation with the base at about the level of the metal matrix. The degree of exposure recommended thus depended on the type of rock formation to be cut.

The difficulties with such placements are several. The difficulties may be understood by considering the dynamics of the drilling operation. In the usual drilling operation, be it mining, coring, or oil well drilling, a fluid such as water, air or drilling mud is pumped through the center of the tool, radially outwardly across the tool face, radially around the outer surface (gage) and then back up to the bore. The drilling fluid clears the tool face of cuttings and to some extent cools the cutter face. Where there is insufficient clearance between the formation cut and the bit body, the cuttings may not be cleared from the face, especially where the formation is soft or brittle. Thus, if the clearance between the cutting surface-formation interface and the tool body face is relatively small and if no provision is made for chip clearance, there may be bit clearing problems.

Other factors to be considered are the weight on the drill bit, normally the weight of the drill string and principally the weight of the drill collar, and the effect of the fluid which tends to lift the bit off the bottom. It has been reported, for example, that the pressure beneath a diamond bit may be as much as 1000 psi greater than the pressure above the bit, resulting in a hydraulic lift, and in some cases the hydraulic lift force exceeds 50% of the applied load while drilling.

One surprising observation made in drill bits having surface-set thermally stable PCD elements is that even after sufficient exposure of the cutting face has been achieved, by running the bit in the hole and after a fraction of the surface of the metal matrix was abraded away, the rate of penetration often decreases. Examination of the bit indicates unexpected polishing of the PCD elements. Usually ROP can be increased by adding weight to the drill string or replacing the bit. Adding weight to the drill string is generally objectionable because it increases stress and wear on the drill rig. Further, tripping or replacing the bit is expensive since the economics of drilling in normal cases are expressed in cost per foot of penetration. The cost calculation takes into account the bit cost plus the rig cost including trip time and drilling time divided by the footage drilled.

Clearly, it is desirable to provide a drilling tool having thermally stable PCD elements and which can be manufactured at reasonable costs and which will perform well in terms of length of bit life and rate of penetration.

It is also desirable to provide a drilling tool having thermally stable PCD elements so located and positioned in the face of the tool as to provide cutting without a long run-in period, and one which provides a sufficient clearance between the cutting elements and the formation for effective flow of drilling fluid and for clearance of cuttings.

Run-in in diamond bits is required to break off the tip or point of the triangular cutter before efficient cutting can begin. The amount of tip loss is approximately equal to the total exposure of natural diamonds. Therefore, an extremely large initial exposure is required for synthetic diamonds as compared to natural diamonds. Therefore, to accommodate expected wearing during drilling, to allow for tip removal during run-in, and to provide flow clearance necessary, substantial initial clearance is needed.

Still another advantage is the provision of a drilling tool in which thermally stable PCD elements of a defined predetermined geometry are so positioned and supported in a metal matrix as to be effectively locked into the matrix in order to provide reasonably long life of the tooling by preventing loss of PCD elements other than by normal wear.

It is also desirable to provide a drilling tool having thermally stable PCD elements so affixed in the tool that it is usable in specific formations without the necessity of significantly increased drill string weight, bit torque, or significant increases in drilling fluid flow or pressure, and which will drill at a higher ROP than conventional fits under the same drilling conditions.

BRIEF SUMMARY OF THE INVENTION

The present invention is an improvement in a rotating bit which includes a plurality of teeth and wherein each such tooth includes a diamond cutting element. The improvement comprises a variation of the angular inclination of adjacent teeth disposed on the face of the bit. Each tooth is subjected to an average vertical loading force and an average wedging force. The wedging force and vertical forces vectorially add to form a resultant force on the tooth. The tooth is inclined at such an angle that the resultant force which is applied to the diamond cutting element within the tooth is oriented in predetermined direction to minimize shearing stress by the resulting force on the diamond cutting element.

More particularly, when the diamond cutting element has a generally triangular prismatic-shape which includes an apical edge formed by two sides of the triangle, the element is disposed on the bit face so that the apical edge extends to form the outermost cutting portion of the diamond cutting element. The tooth is then inclined on the bit so that the resultant force lies approximately along the direction of the bisector of the dihedral angle defined by the apical edge of the diamond cutting element.

The diamond cutting element is further characterized by having a planar leading face which forms a leading face of the corresponding tooth in which it is disposed. The diamond cutting element is then rearwardly raked in the tooth along the longitudinal direction of the tooth at a lifting angle. The leading face of the diamond cutting element is subjected during normal drilling operations to a reactive cutting force by the rock formation. The cutting force and the vertical loading force vectorially add to produce a resultant force applied to the diamond cutting element. The angular rake of the diamond cutting element is chosen so that the average resulting force is approximately perpendicular to the leading face of the diamond cutting element.

The invention is better understood by considering the following drawings wherein like elements are referenced by like numerals.

BRIEF DESCRIPTION OF THE DRAWINGS

FIG. 1 is a cross-sectional view of a tooth taken through a plane perpendicular to the direction of motion of the tooth during normal cutting or drilling operation.

FIG. 2 is a cross sectional view of the tooth shown in FIG. 1 taken through line 2—2 of FIG. 1.

FIG. 3 is a cross sectional view of a portion of a mold forming the tooth of the design shown in FIGS. 1 and 2.

FIG. 5 is a diagrammatic sectional view in reduced scale of one half of the profile of one pad of a first type of the rotating bit shown in plan view in FIG. 4.

FIG. 6 is a diagrammatic view in reduced scale of a second type of pad of the rotating bit shown in FIG. 4.

FIG. 7 is a diagrammatic cross-sectional view in reduced scale of one half of the profile of a third type of pad included on the rotating bit shown in plan view in FIG. 4.

Figure 4:
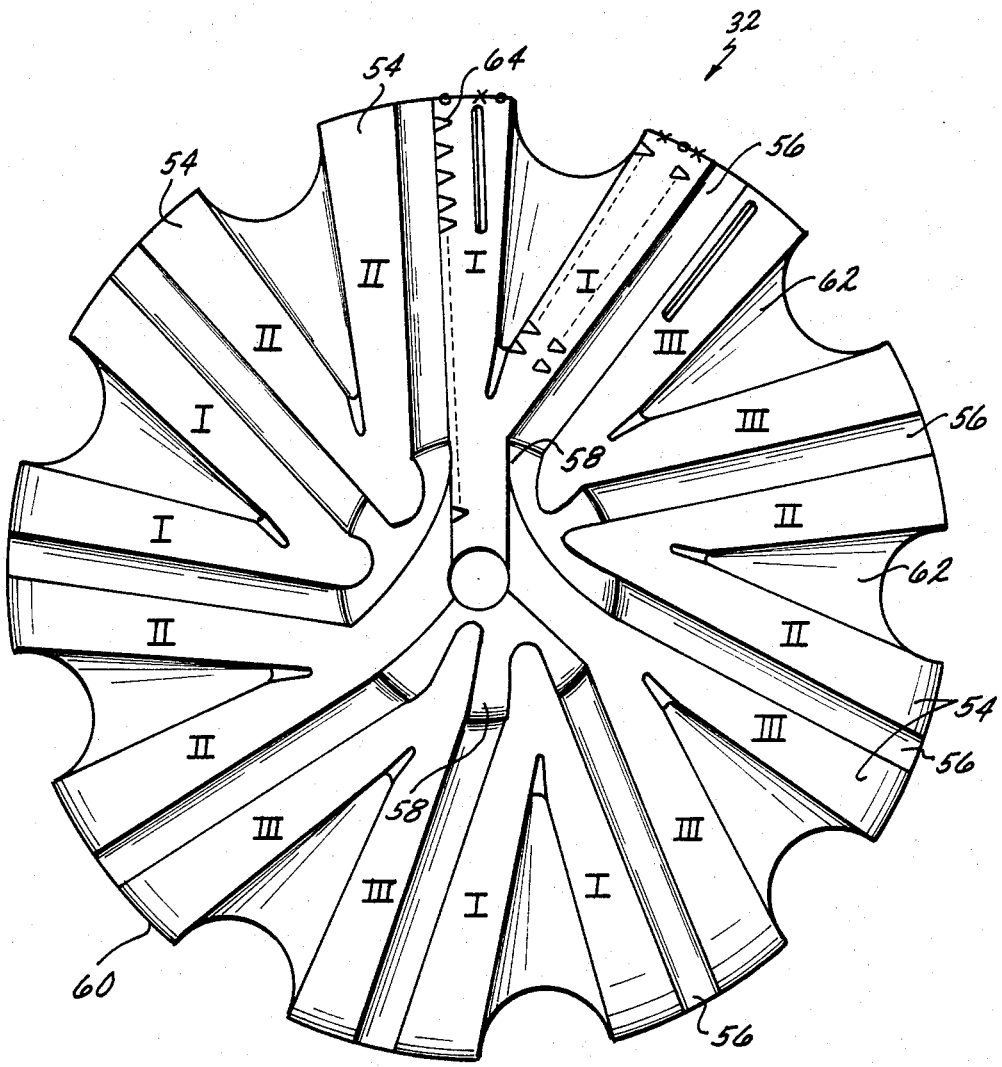
FIG. 4 is a diagrammatic plan view in reduced scale of a rotating bit which incorporates the teeth as described in connection with FIGS. 1-2.

The present invention and its various embodiments are better understood by viewing the above Figures in light of the following detailed description.

DETAILED DESCRIPTION OF THE PREFERRED EMBODIMENTS

The present invention is an improved tooth design which incorporates a diamond cutting element in such a manner that shearing forces on the diamond cutting element during normal cutting or drilling operations are eliminated or at least substantially minimized. Yet, the diamond cutting element is embedded and secured to the bit face of the rotating bit in such a manner so as to securely retain the diamond cutting element on the bit face despite large forces exerted upon the element. The retention of the diamond cutting element on the bit face is further accomplished in such a manner that the amount of matrix material integral with the bit face used for securing the diamond cutting element to the bit face, which material becomes involved in, exposed or is worn during normal cutting or drilling operations, is minimized. Thus, security of attachment of the diamond cutting element to the bit is maximized while interference by such supporting matrix material with cutting by the diamond element is minimized.

Polycrystalline synthetic diamond is commercially available in a variety of geometric shapes and sizes. For example, one such synthetic polycrystalline diamond is manufactured and sold by the General Electric Company under the trademarks GEOSET 2102 AND GEOSET 2103 as a generally triangular, prismatic-shaped element. GEOSET 2102 is an equilaterally, triangularly shaped prism, approximately 4.0 mm on a side and 2.6 mm thick. The larger GEOSET 2103 is similarly shaped and measures 6.0 mm on a side and is approximately 3.7 mm thick. These diamond cutting elements have been developed to the point where they are substantially thermally stable, at least at the temperatures encountered during the furnacing and manufacture of tungsten carbide bits formed by conventional powder metallurgical, infiltration methods.

Turning now to FIG. 1, such a triangular prismatic element 10 is shown in cross-sectional view taken through a plane substantially perpendicular to the longitudinal axis of symmetry of the prismatic polycrystalline diamond element 10. This plane, as it turns out, is also substantially perpendicular to the direction of motion of element 10 as defined by bit rotation. As better shown and described in connection with an illustrated style of a petroleum bit incorporating the present invention shown and described in connection with FIGS. 4–8. PCD element 10 is embedded within matrix material 12 which is integrally formed by conventional powder metallurgical techniques with the crown and bit face of a rotating bit. In the tooth configuration illustrated in FIG. 1, diamond angle 14 is 60 degrees, which is inherently characteristic of the equilateral triangular cross section of prismatic element 10. The apical, dihedral angle 16 of the tooth, generally denoted by reference numeral 18, is greater than angle 14. In the illustrated embodiment, apical tooth angle 16 is approximately 70 degrees. The 10 degrees is filled by an integral extension of matrix material 12 forming a reinforcing arm 20 which forms the exterior exposed side of tooth 18.

Vector 22 represents a force, F1, representative of the vertical component of force applied to tooth 18 or element 10, typically by the weight of the drill string upon the bit. Vector 24 represents a force, F3, which arises from the wedge action against the slope or conical surface of the bit, such as of the type shown in FIG. 8. In other words, the pressure of the sides of the bore or rock formation against tooth 18 will exert a force F3 in the direction of vector 24 on tooth 18 or element 10.

According to the present invention, tooth 18 is inclined with respect to the horizontal axis of the bit at such an angle that the vector sum of forces F1 and F3 result in a vector 26 representative of a force F4 which generally lies along the perpendicular bisector of apical diamond angle 14 of PCD element 10. In general, the angle of inclination of each PCD element 10 is dependent upon its location on the bit face and dependent upon the slope of the bit face at the point of location of tooth 18. The inclination of tooth 18 at each position is chosen so as to approximally cause the time-average resultant vector force F4 to lie at or near the perpendicular bisector of apical diamond angle 14. An illustrated embodiment of the present invention with respect to a selected bit profile is described in detail in FIGS. 4–8 below.

Referring still to FIG. 1, element 10 is thus generally angled with respect to the surface 28 of bit, namely the bit face 28 depending upon the above articulated object. Generally, element 10 will be angled with respect to surface 28 so that one corner 30 is embedded below surface 28, thereby additionally serving to secure and anchor element 10 within matrix material 12. In addition, reinforcing arm 20 provides support in reaction to the vertical load represented by vector 22, F1, which is often the primary force exerted upon tooth 18, particularly when the drill bit is first placed within the bore and drilling just begun. The tangential force F3 does not rise to its full magnitude until tooth 18 is fully engaged in drilling the rock formation. Thus, there may be periods of time during the drilling operation when the resultant vector force 26, F4, on element 10 does not lie near or at the perpendicular bisector of apical diamond angle 14 but lies generally in the vertical direction nearer vector 22. Reinforcing or supporting arm 20 provides the additional reinforcement and mechanical support for element 10 to securely maintain element 10 within tooth 18 in this case.

Turning now to FIG. 2, which is a cross sectional view taken through line 2—2 of FIG. 1, it can be understood that PCD element 16 is also subjected to a cutting force represented by vector 32, F2. Forces represented by the vertical load F1 and vector 32, F2, combine to produce a resultant vector force F5 represented by vector 34. According to the present invention, PCD element 10 is also inclined or raked in a rearward direction as defined by the normal movement of the tooth during cutting operations so that the resultant vectorial force F5 lies substantially along or near the perpendicular to leading face 36 of PCD element 10.

In the illustrated embodiment the angle of rake is approximately 15 degrees to the vertical or longitudinal axis of the rotating bit, which is illustrated in FIG. 2 as lifting angle 38. Matrix material 12 is integrally extended to form a trialing support 40 behind raked PCD element 10 to define the angle or rake, and to provide a contiguous and secure support against cutting force F3. Clearly, the resultant vector 34, F5 is dependent both upon the magnitude of the vertical load F1 and the resistance or cutting force represented by vector 32, F2. The weight of the drill string and the cutting force required to bore through any given rock formation will vary from one application to the other and will vary considerably during the drilling of any given bore. The relative proportions, however, determine the direction of the resultant vector 34 which is arranged by lifting angle 38 to lie generally along the perpendicular to leading face 36, thereby avoiding or substantially minimizing shearing stresses.

Although the illustrated embodiment has suggested that the optimal lifting angle is 15 degrees on the average, it must be clearly understood that other angles can be chosen according to the average vertical loads and cutting forces expected to be encountered in any rock formation to choose an optimum lifting angle according to the present invention. Thus, the shearing force will be minimized by the invention for a predetermined drill string weight and rock formation type for which the bit is specifically designed. Bits intended for different applications will, of course, have differing optimal lifting angles according to the invention.

FIG. 3 is a cross-sectional view of a mold illustrating the means by which teeth 18 described in connection with FIGS. 1 and 2 are manufactured. A conventional graphite molding material 42 is machined using a tool having a dihedral angle substantially equal to apical tooth angle 16, thereby forming an appropriately shaped indentation 44 within graphite material 42. The tool is embedded into material 42 to form indentation 44, which in FIG. 3 is essentially the section as shown in FIG. 1 and thereafter, the tool is drawn downwardly within the plane of the illustration of FIG. 3 and outwardly to form the trailing and tapered support 40 best illustrated in FIG. 2. Thereafter, PCD elements 10 are set or glued within machined indentations 44 such that one side surface 46 of element 10 lies against a corresonding surface of the indentation, leaving a space of a predetermined angle 48 between the opposing side surface and the adjacent wall of indentation 44. The mold is then filled in the conventional manner with metal powder and furnaced in a conventional infiltration method to form an integral mass resulting in a bit with teeth 18 of the design described in connection with FIGS. 1 and 2.

Turning now to FIG. 4, a plan diagrammatic view of a petroleum bit, generally denoted by reference character 52, is illustrated. Bit 52 includes a plurality of pads 54 raised above and defined by a corresponding plurality of waterways 56 communicating with central nozzles 58. Hydraulic fluid provided through the center of bit 52 through an axial manifold, not shown, exits through nozzles 58 down through waterways 56 to the periphery or gage 60 of bit 52, across pads 54 and into collectors 62, which also lead to gage 60. A plurality of teeth 64 in single or multiple rows are set on pads 54, which teeth have the design as described in connection with FIGS. 1 and 2. In this case, surface 28 is the upper surface of pads 54.

Figure 8:
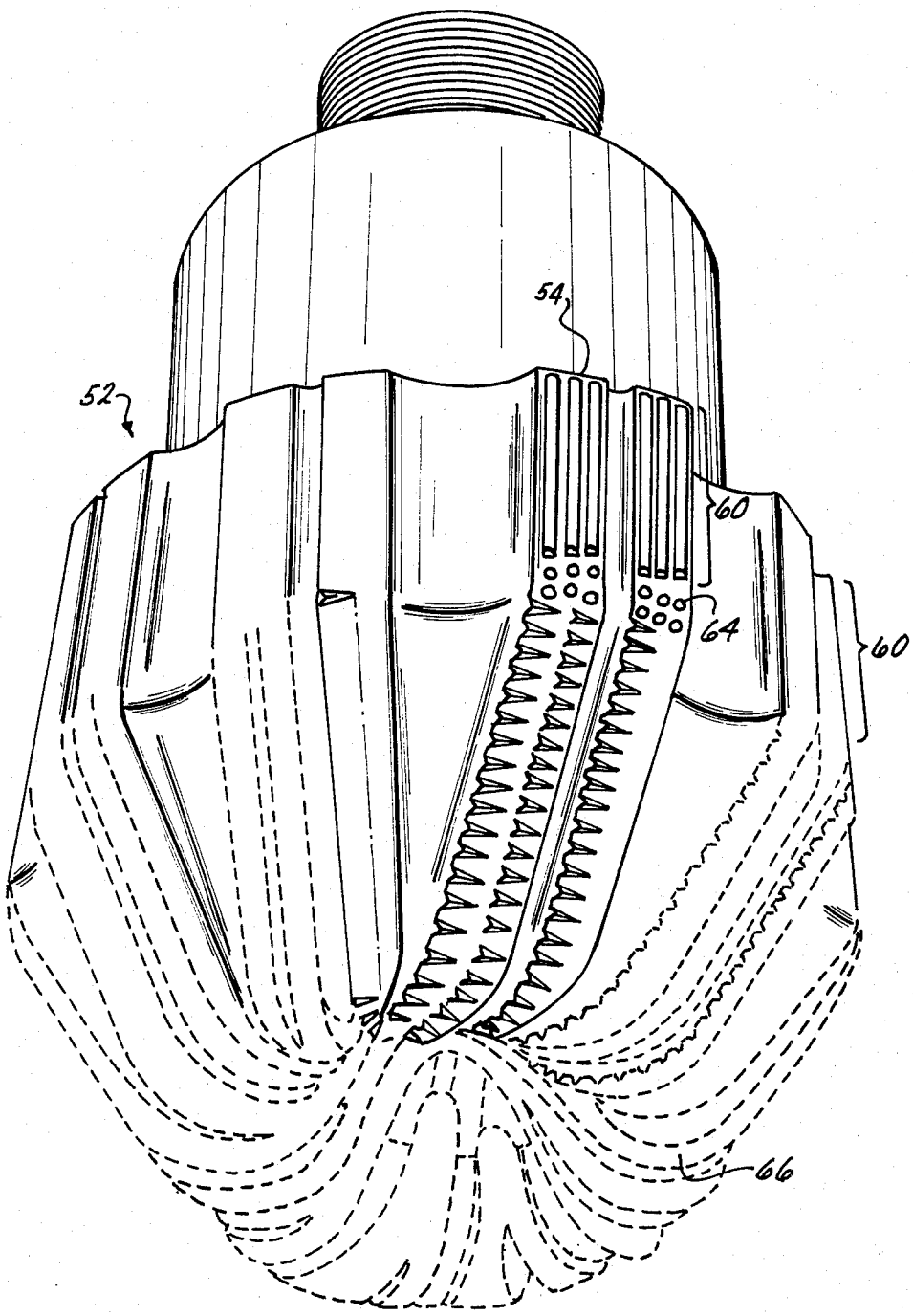
FIG. 8 is a pictorial perspective in reduced scale of the petroleum bit shown in FIGS. 4–7.

FIG. 8 is a pictorial perspective of the bit shown in FIG. 4 and better illustrates the relationship of the plurality of teeth 64 disposed across the upper surface of pads 54 in relationship to gage 60, waterways 56 and collectors 62. Teeth 64 are disposed on bit 52 beginning at or near gage 60 and extend inwardly towards the center of bit 52 across the shoulder, flank, nose and apex of the bit.

A half profile of bit 52 is diagrammatically illustrated in FIG. 5 and shows the placement of teeth 64 on a first type of pad, type 1, shown in plan view in FIG. 4. FIG. 5 illustrates the tooth placement beginning below gage 60 across shoulder 68, nose 70 and into apex 72. Apex 72 terminates at the center of the bit in the region of nozzles 58, except where the pad is extended in the illustrated embodiment to the exact geometric center of bit 52.

Consider now a tooth within shoulder portions 68 of pad type I shown in FIG. 5. The inclination of the bisector of the full apical tooth angle 16 as shown in FIG. 3 is the angle at which the tool forming indentation 44, is directed into mold material 42. The perpendicular bisector of the tooth angle 16, which is not coincident with the perpendicular bisector of PCD element 10 when element 10 is placed within indentation 44 as illustrated in FIG. 3, will thus be defined by a tool entry angle 74 with respect to the vertical or longitudinal axis of the bit, or equivalently of the mold which forms the bit. In the case of a tooth in shoulder portion 68, tool angle 74 is approximately 45 degrees for each of the shoulder teeth. If the tool, as in the illustrated embodiment opens a 70 degree angle for apical tooth angle 16, a 10 degree shoulder 20 will be formed above each PCD element 10 included within such a shoulder tooth.

However, nose 70 of bit 52 departs from the approximately uniform slope of the conical portion characterizing and shoulder 68 and forms a curved surface which transitions into the adjacent apex 72 which once again forms a substantially uniform sloped portion. Teeth 64 included within apex 72, are thus formed in the same manner as described with respect to teeth 64, included within shoulder portion 68. Teeth within nose portions 70 of bit 52 are thus inclined at varying angles to provide a smooth transition between the angular orientation of teeth 64 within shoulder 68 on the one hand and teeth 64 within apex 72 on the other. By this means, the stress applied across nose 70 is evenly loaded across the nose to avoid breakage of the tip of the nose which might otherwise occur but for such a precaution. For example, in the pad of type I as shown in FIG. 5, the first tooth on nose 70 adjacent to shoulder 68 is defined by a tool opening an indentation 44 of the type shown in FIG. 3, which is included with respect to the vertical 76 by an angle of approximately 52 degrees. The tool used to form indentations 44 for the apex teeth opens an apical tooth angle 16 of 60 degrees which is exactly equal to diamond angle 14 as shown in FIG. 1 of the corresponding edge of PCD element 10. Thus, the teeth within apex portion 70 are not provided with the reinforcing arm 20 described in connection with FIG. 1 since substantially all of the load exerted upon the apex teeth is vertical and the addition of such integral matrix material would serve little if any reinforcing function and would only interfer with the efficient cutting operation of the diamond element.

The next tooth is thus formed at an tool entry angle angle 74 of 40 degrees with respect to the vertical 76 as illustrated in FIG. 3. The tool entry angle of each successive tooth decreases towards the center of nose 70 and then increases again to provide a smooth transition to the 45 degree tool entry angle tool position used to make the teeth of apex 72. Thus, as shown for a type I pad in FIG. 5, angle varies successively from the shoulder to the apex by inserting the tool within the mold at a tool entry angle 74 beginning with 52 degrees and followed by a series such as 40 degrees, 28 degrees, 16 degrees, 4 degrees, 8 degrees, 20 degrees, 32 degrees, and 44 degrees for adjacent teeth.

FIGS. 6 and 7 are diagrammatic profile cross sections of additional pads shown in FIG. 4, namely, a type II pad in FIG. 6 and a type III pad in FIG. 7. Again, shoulder 68 and apex 72 are provided with teeth formed by a tool held at an tool entry angle 74, of 45 degrees with respect to vertical 76 to open an apical tooth angle 16 of 70 degrees. In each case, nose teeth within nose portions 70 are opened with a 60 degree tool held at an angle 74 with respect to vertical 76 at the angles as set forth for each tooth in the Figures. Specifically, for a type II pad as illustrated in FIG. 6 beginning with the tooth nearest shoulder 68 and proceeding across nose 70 to the first tooth of apex portion 72, the tool entry angle is at 60 degrees, 48 degrees, 36 degrees, 24 degrees, 12 degrees, 0 degrees, 12, degrees, 24 degrees, 36 degrees, 48 degrees and ends finally with 60 degrees at the tooth next adjacent to apex portion 72. Similarly, a type III pad as illustrated in FIG. 7 beginning with the tooth nearest shoulder 68 and leading towards apex portion 72 is characterized by tool entry angles of 44 degrees, 32 degrees, 20 degrees, 8 degrees, 4 degrees, 16 degrees, 28 degrees, 40 degrees, and finally 50 degrees.

The differing angles between type I, II, and III pads arises from the fact that the placement of teeth on the pad are offset on the bit surface from corresponding teeth in the adjacent pad. In other words, the first tooth adjacent shoulder portion 68 in a type I pad is on a different position of the curve of nose 70 than the first tooth adjacent shoulder portion 68 of a type II pad and type III pad. Only a type II pad as illustrated in connection with FIG. 6, has a tooth at the center of nose 70. The centermost tooth of the type I and III pads are slightly to the left and right of the true center position, respectively, as shown in FIGS. 5 and 7 and thus, the tool entry angle is different. As best seen in FIG. 6, each tooth has a tool entry angle which is 12 degrees different from the tool degree entry angle of the adjacent teeth on nose 70. Thereby, a smooth transition in the cutting action and distribution of stress is provided across nose 70 by the uniformly varied inclination of the nose teeth.

The angular difference between the tool entry angle of adjacent teeth for type I and type III pads is also 12 degrees and differs only from the type II pad by the beginning position of the series of teeth. Thus, as bit 52 rotates it can be appreciated that the three types of pad cut a uniform swath of higher effective tooth density than achievable on any single pad. For example, using tool entry angles as indicated above, the first tooth transversing a segment of an annular cut on the bore as bit 52 rotates can be taken for the purposes of convenience as the tooth on pad II illustrated in FIG. 6 having a zero tool entry angle. The next tooth is the adjacent tooth set at a 4 degree entry angle as pad III illustrated in FIG. 7. The next successive tooth is then the tooth set at an 8 degree entry angle on a type I pad as illustrated on FIG. 5. Four degrees later, a tooth set at a 12 degree angle, again on a type II pad, will cut the next adjacent annular line in the bore. The series continues whereby every 4 degrees as measured by the tool entry angle, a successive tooth passes to cut an even density swath. Teeth on apex 72 and 68 similarly cut an offset pattern among adjacent pads inasmuch as these teeth are placed on shoulders 68 and 72 in the relatively offset manner between pads by virtue of their registration with the teeth within the corresponding nose 70 of each pad.

However, it must be understood that the illustrated embodiment is set forth only as an example and clarification of the invention and it is not intended as a limitation. For example, other angular steps than those described in connections with FIGS. 5–7 could be exploited as well. The variation of angular inclination among nose teeth need not be the 12 degrees as measured by tool entry angle as described, but could be any other suitable angle, such as 15 degrees, depending upon the size and curvature of nose 70 with respect to the size of teeth 18 or PCD element 10 or tooth density on the pads. In addition, the bit shown in connection with FIGS. 4–8, is only one of many bit styles which could have been chosen in which to illustrate the invention. For example, the invention could be adapted according to the present inventions within a coring bit as well as the petroleum bit which is illustrated.

Therefore, it must be understood that many modifications and alterations can be made to the present invention without deparing from its spirit and scope. The illustrated embodiment is shown only by way of example and should not be taken as limiting or defining the invention as set forth in the following claims.

We claim:

1. An improvement in a rotating bit including a plurality of teeth, wherein each tooth includes a synthetic geometrically shaped polycrystalline diamond cutting element, said improvement comprising a selected inclination of each tooth disposed on said bit, each tooth being subjected to an average vertical loading force and an average radial force, said radial force and vertical loading force vectorially adding to form a first resultant force on said tooth, wherein said selected inclination of said tooth is particularly characterized by orientation of said tooth so that said first resultant force as applied to said diamond cutting element included within said tooth is in a predetermined direction to minimize shearing stress by said resultant force on said diamond cutting element, wherein said diamond cutting element has a triangular prismatic shape including an apical edge extending from said bit to form the outermost cutting portion of said diamond cutting element and wherein said tooth is inclined on said bit so that said first resultant force lies approximately along the direction of the bisector of the angle of said apical edge of said diamond cutting element.

2. The improvement of claim 1 wherein said diamond cutting element has a planar leading face forming a leading face of said corresponding tooth and wherein said diamond cutting element is rearwardly raked at a selected lifting angle, said leading face of said diamond cutting element being subjected to an azimuthal cutting force during normal drilling operation, said azimuthal cutting force and vertical loading loading force vectorially adding to apply a second resultant force on said diamond cutting element, said selected lifting angle being chosen so that said second resultant force is approximately perpendicular to said leading face of said diamond cutting element.

3. The improvement of claim 2 wherein said bit is integrally extended to form a trailing support contiguous to and substantially congruous with said diamond cutting element, said trailing support tapering to said bit face at said lifting angle defined with respect to a tangent to the radius to said longitudinal axis of said bit at said corresponding diamond cutting element.

4. The improvement of claim 1 wherein said rotating bit further includes a plurality of rows of said teeth disposed thereon, wherein each said row is characterized by at least one substantially planar portion and a curved portion wherein angular inclination of said teeth uniformly varies across said curved portion to minimize shearing stress thereacross.

5. An improvement in a rotating bit including a plurality of teeth, each tooth including a generally triangular prismatic PCD cutting element, said improvement comprising a predetermined inclination of each tooth on said bit, said generally triangular prismatic diamond cutting element being tangentially set within said tooth and characterized by an outermost extending apical edge, said predetermined inclination particularly characterized by approximate alignment of the bisector of the dihedral angle formed by said apical edge of said diamond cutting element in the direction of the vectorial resultant force applied to said cutting element by vertical loading forces applied to said tooth and by radial wedging forces applied to said tooth, whereby shearing stresses on each said PCD cutting element are substantially avoided and minimized.

6. An improvement in a method of drilling with a rotating bit wherein vertical weight is placed on said bit, said bit comprising a bit face and a plurality of cutting teeth disposed thereon, wherein at least some such cutting teeth have a synthetic geometrically shaped polycrystalline diamond cutting element disposed therein, said improvement comprising the steps of:

rotating said bit within an earth formation to be cut; and cutting said earth formation with said plurality of teeth whereby a reactive force is imposed on each one of said cutting teeth by said earth formation, said improvement characterized by cutting said earth formation to generate said reactive force, said reactive force being spatially oriented and applied to each corresponding diamond cutting element within said tooth to minimize shearing stresses on said diamond element wherein said diamond cutting element has a triangular prismatic shape including a tapered edge extending from said bit face to form the outermost cutting portion of said diamond cutting element, and where in said step of cutting said reactive force is oriented with respect to said diamond cutting element and applied to said diamond cutting element to lie approximately along the direction of the bisector of the angle of said apical edge of said diamond cutting element.

7. The improvement of claim 6 wherein said diamond cutting element has a planar leading face forming a leading face of said corresponding tooth and wherein said diamond cutting element is rearwardly raked at a lifting angle, and where in said step of cutting, said reactive force arising from rotation of said bit within said earth formation is oriented with respect to said leading face of said diamond cutting element so that the vectorial sum of said reactive force arising from rotating said bit and a reactive force applied to said diamond element arising from said vertical weight on said bit equals a resultant force oriented approximately perpendicular to said leading face.

8. The improvement of claim 7 where in said step of cutting, said resultant force is oriented approximately perpendicular to said leading face and approximately parallel to a trailing support contiguous to and substantially congruent with said diamond cutting element, said trailing support tapering to said bit face at said lifting angle, said lifting angle defined with respect to a tangent to a radius to said longitudinal axis of said bit at said diamond cutting element.

9. A rotating bit including a plurality of teeth, wherein each tooth includes a synthetic geometrically shaped polycrystalline diamond cutting element, said bit manufactured by the method comprising the steps of:

determining an average vertical loading force subjected on each tooth;

determining an average radial force applied to each tooth;

determining a first vectorial resultant force on each tooth from said corresponding average vertical loading force and average radial force; and disposing a plurality of diamond cutting elements on said bit, wherein each said diamond cutting element is disposed therein at a selected orientation, the selected orientation of each diamond element particularly characterized by disposing said diamond element on said bit so that said first resultant force applied to said diamond cutting element is oriented in a predetermined direction with respect to said diamond cutting element in order to minimize shearing stress by said first resultant force on said diamond cutting element, wherein at least some of said diamond cutting elements have a triangular prismatic shape including an apical edge extending from said bit to form the outermost cutting portion of said diamond cutting element and wherein said tooth corresponding to said diamond cutting element in said step of disposing said diamond cutting elements is oriented on said bit so that said first resultant force lies approximately along the direction of the bisector of the angle of said apical edge of said diamond cutting element.

10. The bit of claim 9 further comprising the steps of determining an azimuthal cutting force applied to each diamond cutting element when said bit rotates in an earth formation, and where in said step of disposing said diamond element, at least some of said diamond elements are disposed with a rearward rake at a lifting angle, said lifting angle being chosen so that said azimuthal cutting force and said average vertical loading force vectorially add to result in a second resultant force on said diamond cutting element, said diamond cutting element being oriented so that said second resultant force is approximately perpendicular to said leading face of said diamond cutting element.

11. The bit of claim 10 where in said step of disposing said diamond cutting elements, a trailing support contiguous to and substantially congruous with said diamond cutting element is formed, said trailing support tapers to said bit face at said lifting angle defined with respect to the tangent to the radius to said longitudinal axis of said bit at said corresponding diamond cutting element.

12. A rotating bit comprising:

a bit body defining a bit face with a predetermined bit profile, said bit being associated with an expected average vertical loading force and an expected average radial force when said rotating bit is rotated within an earth formation, and a plurality of teeth disposed on said bit surface, at least some of the teeth including a synthetic geometrically shaped polycrystalline diamond cutting element therein, said average vertical loading force and average radial force vectorially adding at each said tooth to form a first resultant force on said tooth, said tooth being disposed on said bit face in an orientation to minimize shearing stresses on said diamond cutting element within said tooth arising from said first resultant force, wherein at least some of said diamond cutting elements have an exposed planar leading face forming a leading face of said corresponding tooth, said diamond cutting element characterized by a rearward rake at a selected lifting angle corresponding to said diamond cutting element, said leading face of said diamond cutting element being subjected to an azimuthal cutting force during rotation of said bit within said earth formation, said azimuthal cutting force and said vertical loading force vectorially adding to apply a second resultant force on said diamond cutting element, said rearward rake of said diamond cutting element at said lifting angle being chosen so that said second resultant force is approximately perpendicular to said leading face of said corresponding cutting tooth.

* * * * *